US012692052B2

(12) United States Patent
Pinelli et al.

(10) Patent No.: US 12,692,052 B2
(45) Date of Patent: Jul. 28, 2026

(54) QUICK-FILL BEVERAGE CONTAINER LID

(71) Applicant: Leapfrog Product Development LLC, Chicago, IL (US)

(72) Inventors: Steven N. Pinelli, Chicago, IL (US); Brian M. Clemens, Chicago, IL (US)

(73) Assignee: Leapfrog Product Development LLC, Chicago, IL (US)

( * ) Notice: Subject to any disclaimer, the term of this patent is extended or adjusted under 35 U.S.C. 154(b) by 0 days.

(21) Appl. No.: 18/772,748

(22) Filed: Jul. 15, 2024

(65) Prior Publication Data

US 2025/0153910 A1 May 15, 2025

Related U.S. Application Data

(60) Provisional application No. 63/598,992, filed on Nov. 15, 2023.

(51) Int. Cl.

| | |
|---|---|
| ***B65D 51/18*** | (2006.01) |
| ***A47G 19/22*** | (2006.01) |
| ***B65D 47/06*** | (2006.01) |
| ***B65D 47/08*** | (2006.01) |
| ***B65D 51/16*** | (2006.01) |
| ***B65D 51/24*** | (2006.01) |
| ***B65D 55/02*** | (2006.01) |

(52) U.S. Cl.

CPC ..... *B65D 51/18* (2013.01); *A47G 19/2272* (2013.01); *B65D 47/065* (2013.01); *B65D 47/0857* (2013.01); *B65D 51/1672* (2013.01); *B65D 51/24* (2013.01); *B65D 55/02* (2013.01); *B65D 2205/02* (2013.01)

(58) Field of Classification Search

CPC .. B65D 51/18; B65D 47/065; B65D 47/0857; B65D 51/1672; B65D 51/24; B65D 55/02; B65D 2205/02; B65D 2251/0021; B65D 2251/0087; B65D 47/0871; A47G 19/2272

See application file for complete search history.

(56) References Cited

U.S. PATENT DOCUMENTS

| | | | | |
|---|---|---|---|---|
| 6,382,476 | B1 | 5/2002 | Randall et al. | |
| 2012/0234789 | A1 | 9/2012 | Mason | |
| 2013/0220966 | A1 | 8/2013 | Lane | |
| 2019/0062006 | A1* | 2/2019 | Breit | B65D 41/0435 |

(Continued)

OTHER PUBLICATIONS

International Search Report and Written Opinion for PCT/US2024/042904 dated Nov. 4, 2024 (8 pages).

*Primary Examiner* — James N Smalley

(74) *Attorney, Agent, or Firm* — Barnes & Thornburg LLP

(57) ABSTRACT

A quick-fill lid assembly for a beverage container. The lid assembly has a lid housing that connects to the beverage container, a fill cap pivotally attached to the lid housing, and a top closure pivotally attached to the lid housing and covering a portion of the fill cap. The lid housing has an opening providing access to a cavity of the beverage container, and a connector adjacent the opening. A straw connects to the connector and extends into the beverage container. A drink spout is connected to the fill cap and contacts the connector when the fill cap is in the closed position such that a fluid passageway of the drink spout is fluidly connected to the connector passageway and to a passageway through the straw to allow the user to drink from the beverage container through the drink spout.

20 Claims, 10 Drawing Sheets

(56) References Cited

U.S. PATENT DOCUMENTS

| | | | | |
|---|---|---|---|---|
| 2021/0085104 | A1 | 3/2021 | Pinelli et al. | |
| 2022/0048683 | A1 | 2/2022 | Bagley | |
| 2024/0083641 | A1* | 3/2024 | Wong | B65D 51/18 |

* cited by examiner

QUICK-FILL BEVERAGE CONTAINER LID

CROSS-REFERENCE TO RELATED APPLICATIONS

This application claims the benefit of U.S. Provisional Patent Application No. 63/598,992 filed Nov. 15, 2023, which is expressly incorporated herein by reference and made a part hereof.

FEDERALLY SPONSORED RESEARCH OR DEVELOPMENT

Not Applicable.

TECHNICAL FIELD

The present subject matter relates to a lid for a beverage container, and more particularly, to a lid having both chug and sip functionality, as well as quick-fill functionality.

BACKGROUND

Beverage containers are known in the art. While such products according to the prior art provide a number of advantages, they nevertheless have certain limitations, especially when combined together. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology relates to lids for beverage containers that have quick-fill functionality.

The disclosed technology further relates to a quick-fill lid assembly for a beverage container, comprising: a lid housing adapted to be connected to the beverage container, the lid housing having an opening providing access to a cavity of the beverage container, the lid housing also having a connector adjacent the opening, wherein the connector has a passageway therethrough; a straw connected to the connector and extending into the beverage container; a fill cap pivotally attached to the lid housing, the fill cap moving between a closed position and an open position, wherein the fill cap closes the opening in the lid housing in its closed position; a drink spout connected to the fill cap, the drink spout having a first end and a second end, and a fluid passageway extending from the first end to the second end, the second end of the drink spout contacting the connector when the fill cap is in the closed position such that the fluid passageway of the drink spout is fluidly connected to the passageway through the connector and to a passageway through the straw to allow the user to drink fluid from the beverage container through the drink spout; and, a top closure pivotally attached to the lid housing, the top closure moving between an open position and a closed position, wherein the top closure covers the drink spout when the top closure is in the closed position.

The disclosed technology further relates to a quick-fill lid assembly for a beverage container, comprising: a lid housing adapted to be connected to the beverage container, the lid housing having an opening providing access to a cavity of the beverage container; a fill cap pivotally attached to the lid housing, the fill cap moving between a closed position and an open position, wherein the fill cap closes the opening in the lid housing in its closed position; a drink spout connected to the fill cap; and, a top closure pivotally attached to the lid housing, the top closure moving between an open position and a closed position, wherein the top closure covers the drink spout when the top closure is in the closed position.

The disclosed technology further relates to a quick-fill lid assembly for a beverage container, comprising: a lid housing adapted to be connected to the beverage container, the lid housing having an opening providing access to a cavity of the beverage container, the lid housing also having a connector adjacent the opening, wherein the connector has a passageway therethrough; a straw connected to the connector and extending into the beverage container; a fill cap pivotally attached to the lid housing, the fill cap moving between a closed position and an open position, wherein the fill cap closes the opening in the lid housing in its closed position; and, a drink spout connected to the fill cap, the drink spout having a first end and a second end, and a fluid passageway extending from the first end to the second end, the second end of the drink spout contacting the connector when the fill cap is in the closed position such that the fluid passageway of the drink spout is fluidly connected to the passageway through the connector and to a passageway through the straw to allow the user to drink fluid from the beverage container through the drink spout.

The disclosed technology further relates to a quick-fill lid assembly for a beverage container, wherein the top closure and the fill cap are independently pivotally connected to the housing.

The disclosed technology further relates to a quick-fill lid assembly for a beverage container, wherein the top closure is pivotal about a pivot shaft, and wherein the fill cap is pivotal about the same pivot shaft.

The disclosed technology further relates to a quick-fill lid assembly for a beverage container, wherein the top closure has a cover portion, pivot arms and a release flange.

The disclosed technology further relates to a quick-fill lid assembly for a beverage container, wherein the release flange on the top closure engages a lock receiver on the lid housing.

The disclosed technology further relates to a quick-fill lid assembly for a beverage container, wherein the fill cap has a cover portion, pivot arms, a release member and a release flange.

The disclosed technology further relates to a quick-fill lid assembly for a beverage container, wherein the release flange on the fill cap engages a lock receiver on the lid housing.

The disclosed technology further relates to a quick-fill lid assembly for a beverage container, wherein the fill cap has a button, and wherein when the button is depressed the release flange of the top closure is disengaged from the lock receiver of the top closure to open the top closure.

The disclosed technology further relates to a quick-fill lid assembly for a beverage container, wherein the fill cap is opened the top closure remains in the closed position.

The disclosed technology further relates to a quick-fill lid assembly for a beverage container, wherein to access the cavity of the beverage container with the lid assembly on the beverage container, the top closure and the fill cap are moved to the open position.

The disclosed technology further relates to a quick-fill lid assembly for a beverage container, wherein the lid housing has a connector adjacent the opening, the connector having a passageway therethrough, and further comprising a straw connected to the connector and extending into the beverage container.

The disclosed technology further relates to a quick-fill lid assembly for a beverage container, wherein the drink spout has a first end and a second end, and a fluid passageway extending from the first end to the second end, the second end of the drink spout contacting the connector when the fill cap is in the closed position such that the fluid passageway of the drink spout is fluidly connected to the passageway through the connector and to a passageway through the straw to allow the user to drink fluid from the beverage container through the drink spout.

The disclosed technology further relates to a quick-fill lid assembly for a beverage container, wherein the top closure and the fill cap are independently pivotally connected to the housing, wherein the top closure is pivotal about a pivot shaft, and wherein the fill cap is pivotal about the same pivot shaft.

The disclosed technology further relates to a quick-fill lid assembly for a beverage container, wherein the fill cap has a cover portion, pivot arms, a release member and a release flange, and wherein the release flange on the fill cap engages a lock receiver on the lid housing.

The disclosed technology further relates to a quick-fill lid assembly for a beverage container, wherein the top closure has a cover portion, pivot arms and a release flange, and wherein the release flange on the top closure engages a lock receiver on the lid housing.

The disclosed technology further relates to a quick-fill lid assembly for a beverage container, further comprising a top closure pivotally attached to the lid housing, the top closure moving between an open position and a closed position, wherein the top closure covers the drink spout when the top closure is in the closed position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
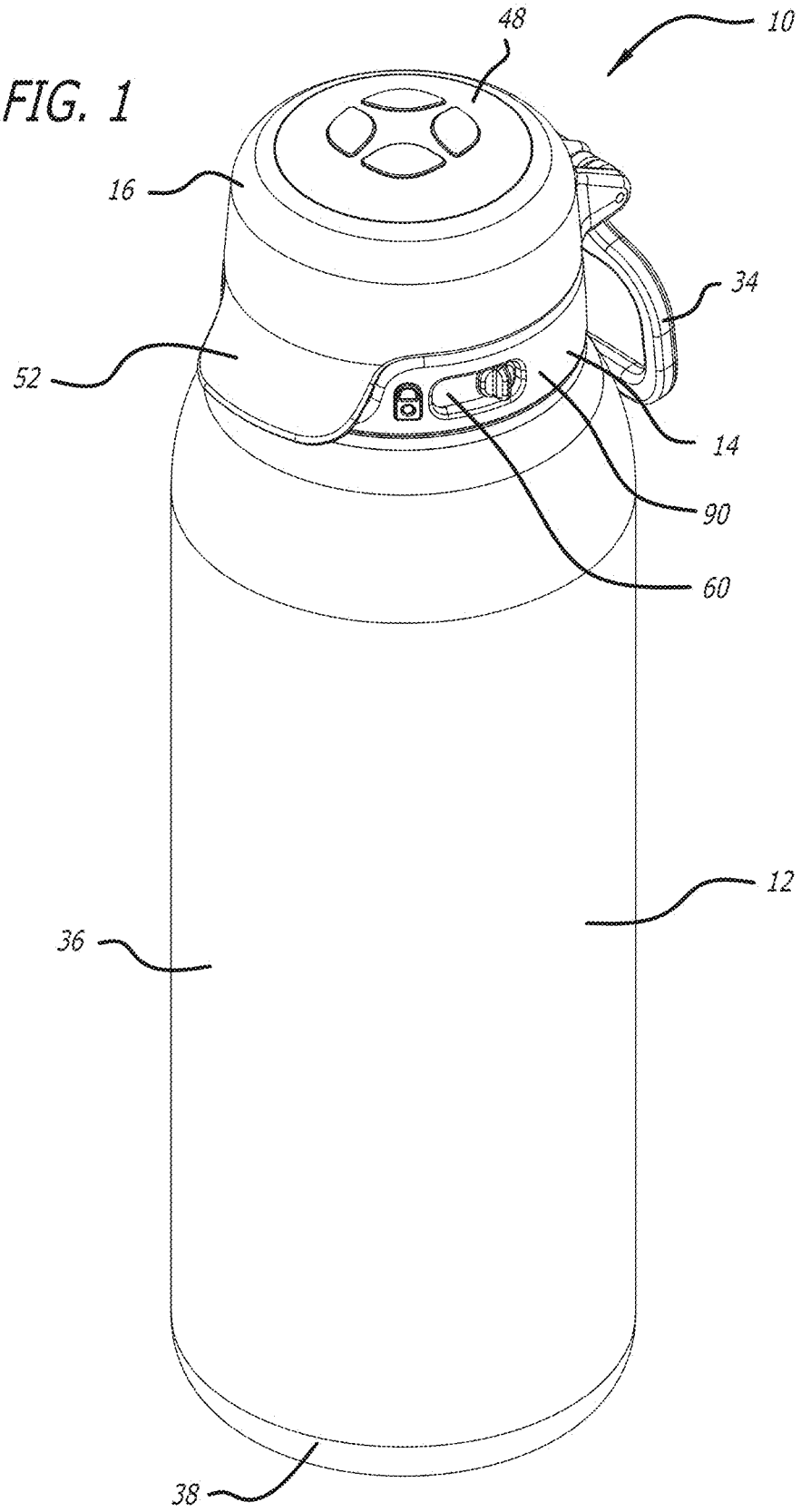
FIG. 1 is a perspective view of a quick-fill lid for a beverage container, with the lid in the closed position, according to the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible of embodiments in many different forms, there is shown in the drawings and will herein be described in detail preferred embodiments with the understanding that the present disclosure is to be considered as an exemplification of the principles of the disclosure and is not intended to limit the broad aspect of the disclosure to the embodiments illustrated. It should be noted that the features illustrated in the drawings are not necessarily drawn to scale, and features of one embodiment may be employed with other embodiments as one of ordinary skill in the relevant art would recognize, even if not explicitly stated herein. Further, descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skill in the art to practice the embodiments of the present disclosure. Accordingly, the examples and embodiments herein should not be construed as limiting the scope of the present disclosure, which is defined solely by the appended claims and applicable law.

Generally, this disclosure describes several embodiments of a quick-fill lid assembly for a beverage container, where the lid assembly has both chug and sip functionality, as well as quick-fill functionality. In both embodiments the top closure can be opened independently of the fill cap to allow the user to drink from the drink spout. In one embodiment, the fill cap can be opened without the top closure being opened first (required only one step for opening to chug and fill), and in another embodiment the fill cap can only be opened if the top closure is first separately opened (requires two steps for opening to chug and fill).

Referring now to the figures, and initially to FIGS. 1-4, there is shown an embodiment of a lid assembly 10 for a beverage container 12. The lid assembly 10 in this embodiment may be referred to as a flip and fill lid. The lid assembly 10 generally comprises a lid housing 14, a top closure 16, a fill cap 18, and a drink spout 20. The drink spout 20 has a first end 21 and a second end 23. In one embodiment, the lid assembly 10 has a connector 22 and a straw 24. The connector 22 fluidly connects the drink spout 20 and the straw 24. Further, in one embodiment, the lid assembly 10 has a first seal 26 for sealing an opening 92 in the lid housing 14 with the fill cap 18, a second seal 28 for sealing the lid housing 14 to the beverage container 12, and a connection mechanism 30 for securing the lid housing 14 to the beverage container 12. In one embodiment, the lid assembly 10 has a locking mechanism 32 for locking the top closure 16 in the closed position. The lid assembly 10 may also have a pivotable carry ring 34.

Figure 4:
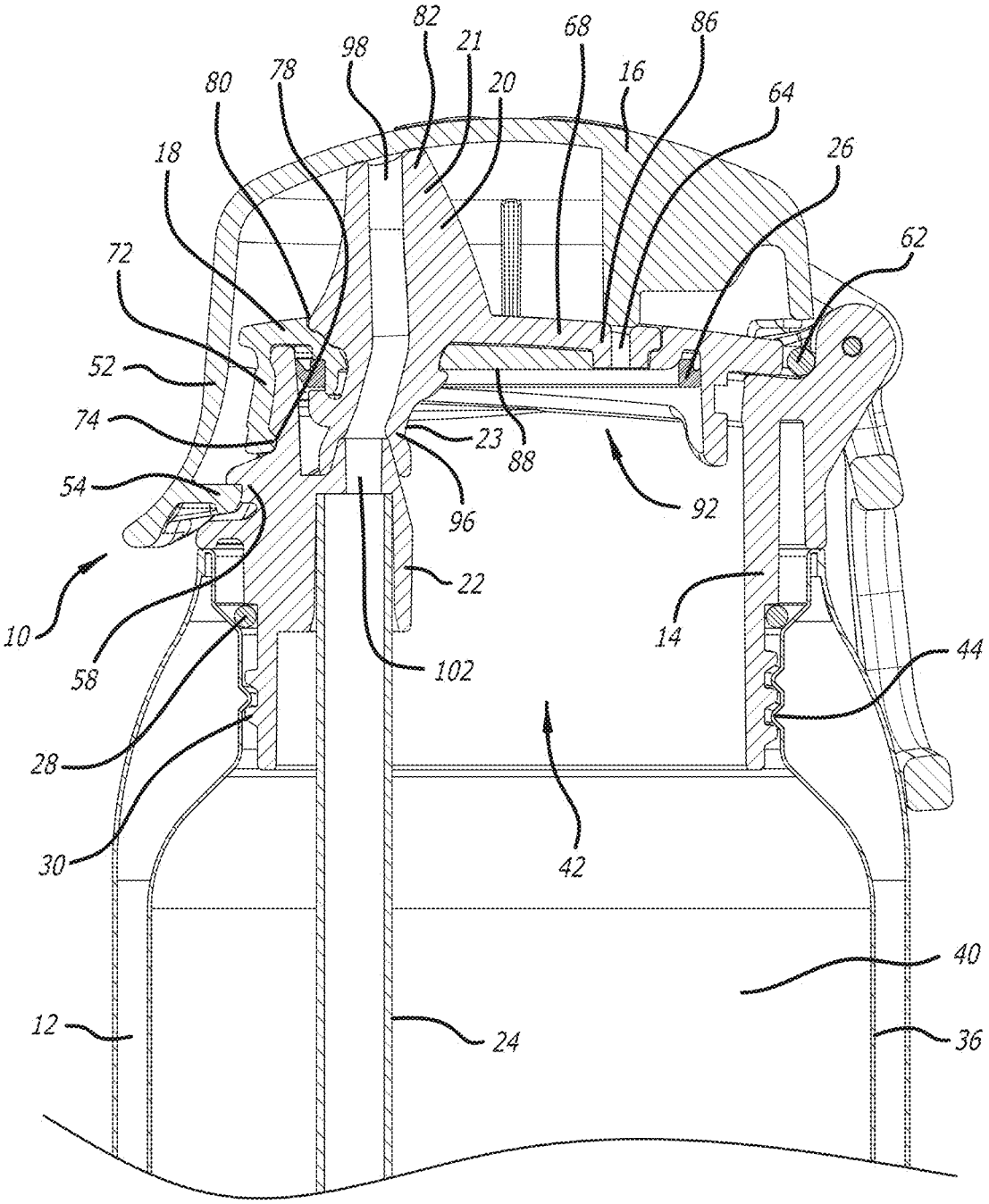
FIG. 4 is a cross-sectional view of the quick-fill lid of FIG. 1 in the closed position, according to the present disclosure.

As shown in FIG. 4, the beverage container 12 typically has a side wall 36 and a bottom wall 38 defining an internal cavity 40 for storing liquid. An opening 42 is provided at the top of the beverage container 12 to provide access to the internal cavity 40. The beverage container 12 also has a connection system 44 for securing the lid housing 14 to the beverage container 12 at the opening 42 thereof. In one embodiment, the connection system 44 comprises a female thread component at the opening 42 of the container 12, and the connection mechanism 30 of the lid housing 14 comprises a mating male thread component, however the reverse is acceptable, as well as a variety of other systems for securing the lid housing 14 to the beverage container 12. The second seal 28 may be provided adjacent the connection mechanism 30 of the lid housing 14 to seal the lid housing 14 to the beverage container 12 when the lid housing 14 is secured to the beverage container 12.

In one embodiment, the top closure 16 and the fill cap 18 are independently pivotally connected to the lid housing 14. Further, in one embodiment, the top closure 16 and the fill cap 18 are pivotal about the same axis at the same pivot shaft 46.

Figure 2:
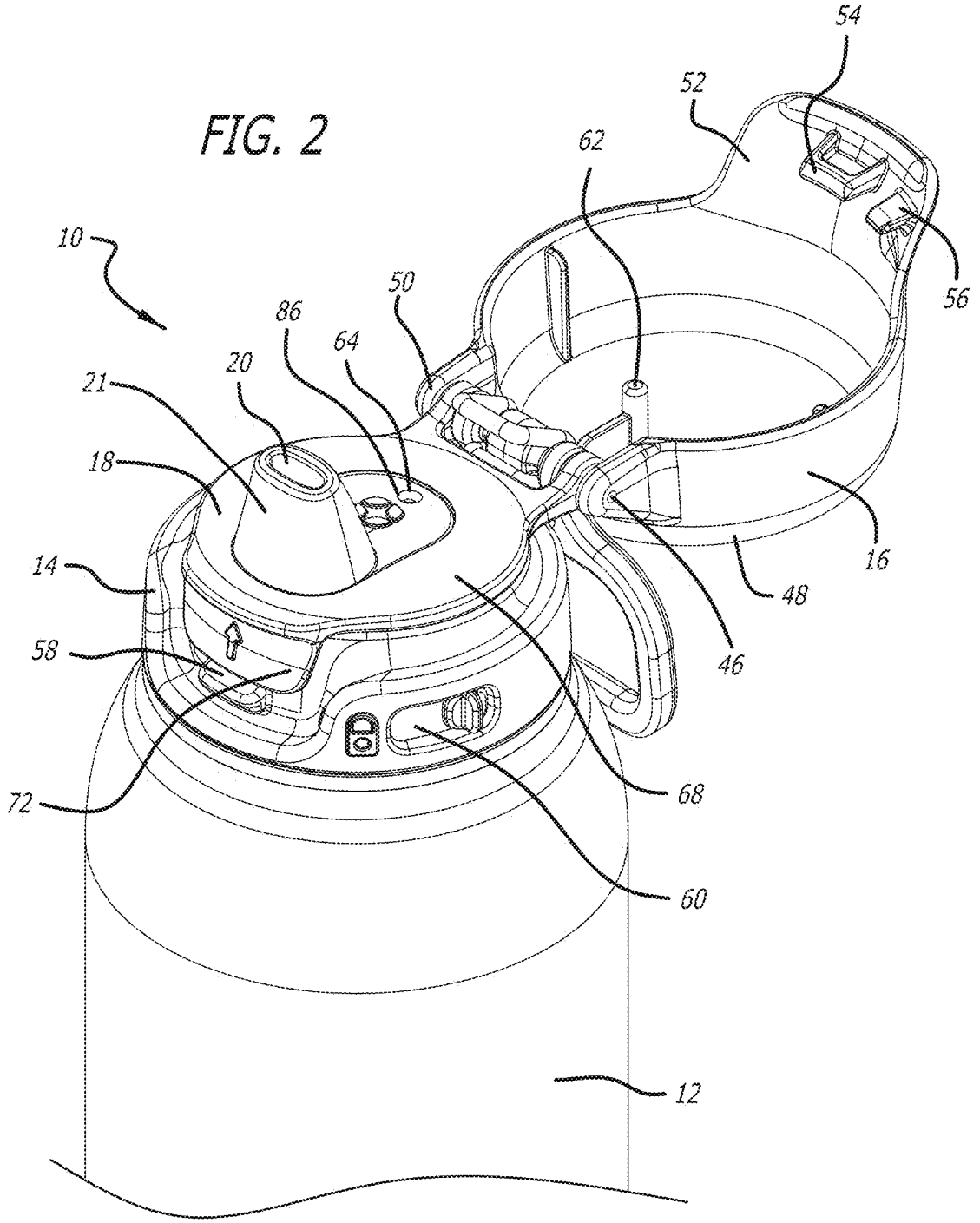
FIG. 2 is a perspective view of the quick-fill lid of FIG. 1, with the top closure pivoted open and the fill cap in the closed position, according to the present disclosure.
Figure 3:
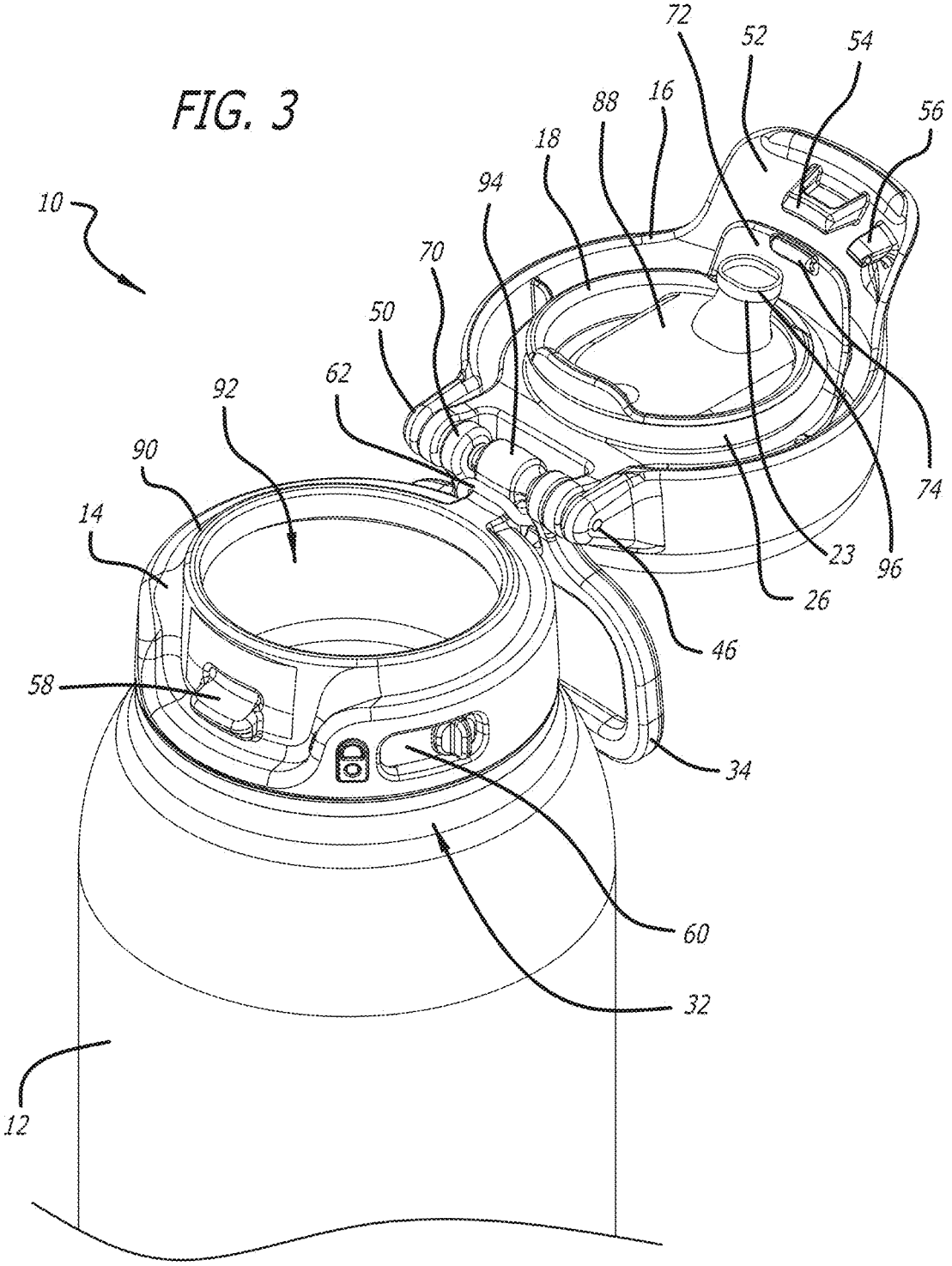
FIG. 3 is a perspective view of the quick-fill lid of FIG. 1, with the top closure and the fill cap pivoted open, according to the present disclosure.

As shown in FIGS. 1-4, in one embodiment the top closure 16 has a cover portion 48, pivot arms 50, a release member 52, a release flange 54, and a lock tab 56. The pivot arms 50 are pivotally secured to the pivot shaft 46 of the lid housing 14. The top closure 16 can pivot from a closed position, as shown in FIGS. 1 and 4, to an open position, as shown in FIGS. 2 and 3 about the pivot shaft 46. The release flange 54 extends from the release member 52 and engages a lock receiver 58 on the lid housing 14 in the closed position, typically in a snap manner, to secure the top closure 16 in the closed position on the lid housing 14. To open the top closure 16 the user pulls on the release member 52 to disengage the release flange 54 from the lock receiver 58, and to allow the top closure 16 to pivot to the open position about the pivot shaft 46 as shown in FIG. 2. In one embodiment, a bias member 62 is provided to bias the top closure 16 to the open position of FIG. 3 when the release flange 54 is disengaged from the lock receiver 58.

In one embodiment, a sliding lock member 60 of the locking mechanism 32 on the lid housing 14 can be moved between an unlocked position and a locked position. In the locked position the sliding lock member 60 engages the lock tab 56 of the top closure 16 to prevent the top closure 16 from being moved from the closed position. In one embodiment, the top closure 16 also has a vent closure member 62 to close a vent opening 64 in the fill cap 18 when the top closure 16 is in the closed position.

Moving to the fill cap 18, in one embodiment the fill cap 18 has a cover portion 68, pivot arms 70, a release member 72, and a release flange 74. The pivot arms 70 are pivotally secured to the pivot shaft 46 of the lid housing 14. The fill cap 18 can pivot from a closed position, as shown in FIGS. 2 and 4, to an open position, as shown in FIG. 3 about the pivot shaft 46. The release member 72 extends downwardly from the cover portion 68. The release flange 74 extends from the release member 72 and engages a lock receiver 78 on the lid housing 14 in the closed position to secure the fill cap 18 in the closed position on the lid housing 14. To open the fill cap 18 the user pulls on the release member 72 to disengage the release flange 74 from the lock receiver 78, and to allow the fill cap 18 to pivot to the open position about the pivot shaft 46, as shown in FIG. 3.

In one embodiment, the fill cap 18 has a first opening 80 through the cover portion 68. The first opening 80 may be a drink opening, and may have a drink member 20 therein, such as a silicone drink spout 20, to be used by the user in drinking the liquid from the container cavity 40. Further, in one embodiment the fill cap 18 may have a second opening 64 to be used as a vent opening 64. The vent opening 64 may be sealed by the vent closure member 62 of the top closure 16 when the top closure 16 and fill cap 18 are in the closed position. Further, a seal 86 may be provided in the vent opening 64 to allow for better sealing of the vent opening 64 by the vent closure member 62. The drink spout 20 may be sealed closed by the top closure 16 when the top closure 16 is closed as shown in FIG. 4. As shown in FIGS. 3 and 4, the first seal 26, which is preferably connected adjacent a bottom 88 of the fill cap 18, seals the fill cap 18 to the lid housing 14 to sealingly close the opening 92 in the lid housing 14.

The lid housing 14 has housing body 90, a central opening 92 through the housing body 90, and a connection mechanism 30 to secure the lid housing 14 to the beverage container 12. The central opening 92 provides access to the internal cavity 40 of the beverage container 12 when the lid assembly 10 is secured to the beverage container 12. Thus, the first seal 26, which is preferably connected adjacent a bottom 88 of the fill cap 18, seals the central opening 92 of the lid housing 14 closed when the fill cap 18 is in the closed position. Additionally, the second seal 28 is provided around the connection mechanism 30 of the lid housing 14 to seal the lid housing 14 to the beverage container 12 when the lid housing 14 is secured to the beverage container 12. This sealingly closes the opening 42 at the top of the beverage container 12 to close access to the internal cavity 40 of the beverage container 12. The lid housing 14 also has a pivot arm 94 extending from the housing body 90 to secure the pivot shaft 46 thereto for engaging with the pivot arms 50 of the top closure 16 and the pivot arms 70 of the fill cap 18.

As best shown in FIG. 4, in one embodiment, the lid housing 14 has a connector 22. In one embodiment, the drink spout 20 has a sipping portion 82 extending above the cover portion 68 of the fill cap 18, and an engaging portion 96 extending below the bottom 88 of the fill cap 18. A fluid passageway 98 extends through the entirety of the drink spout 20, from the first end 21 to the second end 23. The engaging portion 96 of the drink spout 20 sealingly engages a top of the connector 22 when the fill cap 18 is in the closed position as shown in FIG. 4. In one embodiment, a straw 24 can be secured to a bottom of the connector 22. The connector 22 similarly has a fluid passageway 102 extending therethrough to fluidly connect the fluid passageway 98 of the drink spout 20 with the straw 24. The straw 24 may extend close to the bottom wall 38 of the beverage container 12 such that when the user sips or sucks on the drink spout 20, liquid is drawn from the bottom of the internal cavity 40 of the beverage container 12, through the straw 24, through the fluid passageway 102 in the connector 22, through the fluid passageway 98 in the drink spout 20 and into the mouth of the user.

Unlike many beverage containers, the user can fill the internal cavity 40 of the beverage container 12 of this embodiment without removing the lid assembly 10. The user merely pivots open the top cap 16, and then pivots open the fill cap 18. When the fill cap 18 is opened the large central opening 92 through the housing body 90 of the lid housing 14 is accessible. The user can fill the internal cavity 40 of the beverage container with liquid directly through the large central opening 92 of the housing body 90. Further, the user can drink, such as a chug, directly from the large central opening 92 as well instead of through the drink spout 20, if so desired.

Referring now to FIGS. 5-8, there is shown another embodiment of a lid assembly 100 for a beverage container 12. The lid assembly 100 in this embodiment may be referred to as a pop and fill lid. The lid assembly 100 generally comprises a lid housing 114, a top closure 116, a fill cap 118, and a drink spout 120. In one embodiment, the lid assembly 100 has a connector 122 and a straw 124. The connector 122 fluidly connects the drink spout 120 and the straw 124. Further, in one embodiment, the lid assembly 100 has a first seal 126 for sealing an opening 192 in the lid housing 114 with the fill cap 118, a second seal 128 for sealing the lid housing 114 to the beverage container 12, and a connection mechanism 130 for securing the lid housing 114 to the beverage container 12. In one embodiment, the lid assembly 100 has a locking mechanism 132 for locking the top closure 116 in the closed position. The lid assembly 100 may also have a pivotable carry ring 34.

One difference between the lid assembly 100 of this embodiment and the lid assembly 10 of the prior embodiment is that the user can open the fill cap 118 without first having to open the top closure 116. Thus, the user can access the large central opening 192 to fill the container 12, or to drink/chug from the large central opening 192, without first having to open the top closure 116. The top closure 116 can remain secured to the fill cap 118 when the fill cap 118 is in the open position, as shown in FIG. 7, and when the fill cap 118 is in the closed position, as shown in FIGS. 5 and 8.

The beverage container 12 can be identical to the beverage container 12 previously discussed herein. Thus, the beverage container 12 has a connection system 44 for securing the lid housing 114 to the beverage container 12 at the opening 42 thereof. In one embodiment, the connection system 44 comprises a female thread component at the opening 42 of the container 12, and the connection mechanism 130 of the lid housing 114 comprises a mating male thread component, however the reverse is acceptable, as well as a variety of other systems for securing the lid housing 114 to the beverage container 12. The second seal 128 may be provided adjacent the connection mechanism 130 of the lid housing 114 to seal the lid housing 114 to the beverage container 12 when the lid housing 114 is secured to the beverage container 12.

Figure 6:
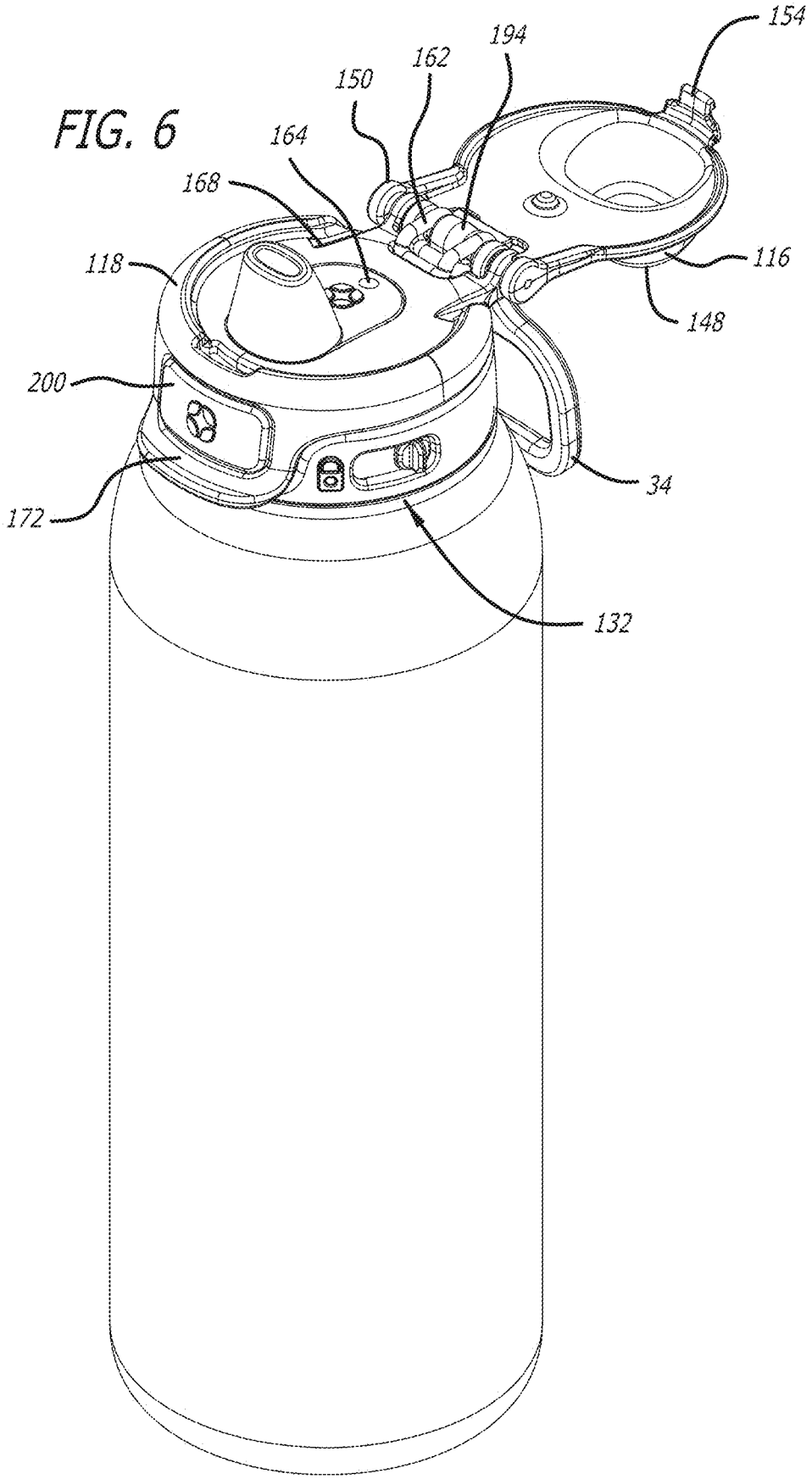
FIG. 6 is a perspective view of the quick-fill lid of FIG. 5, with the top closure pivoted open and the fill cap in the closed position, according to the present disclosure.

In one embodiment, the top closure 116 and the fill cap 118 are independently pivotally connected to the lid housing 114 as shown in FIG. 6. Alternately, the top closure 116 and the fill cap 118 may be pivoted together as shown in FIG. 7. Further, in one embodiment, the top closure 116 and the fill cap 118 are pivotal about the same axis at the same pivot shaft 146.

Figure 5:
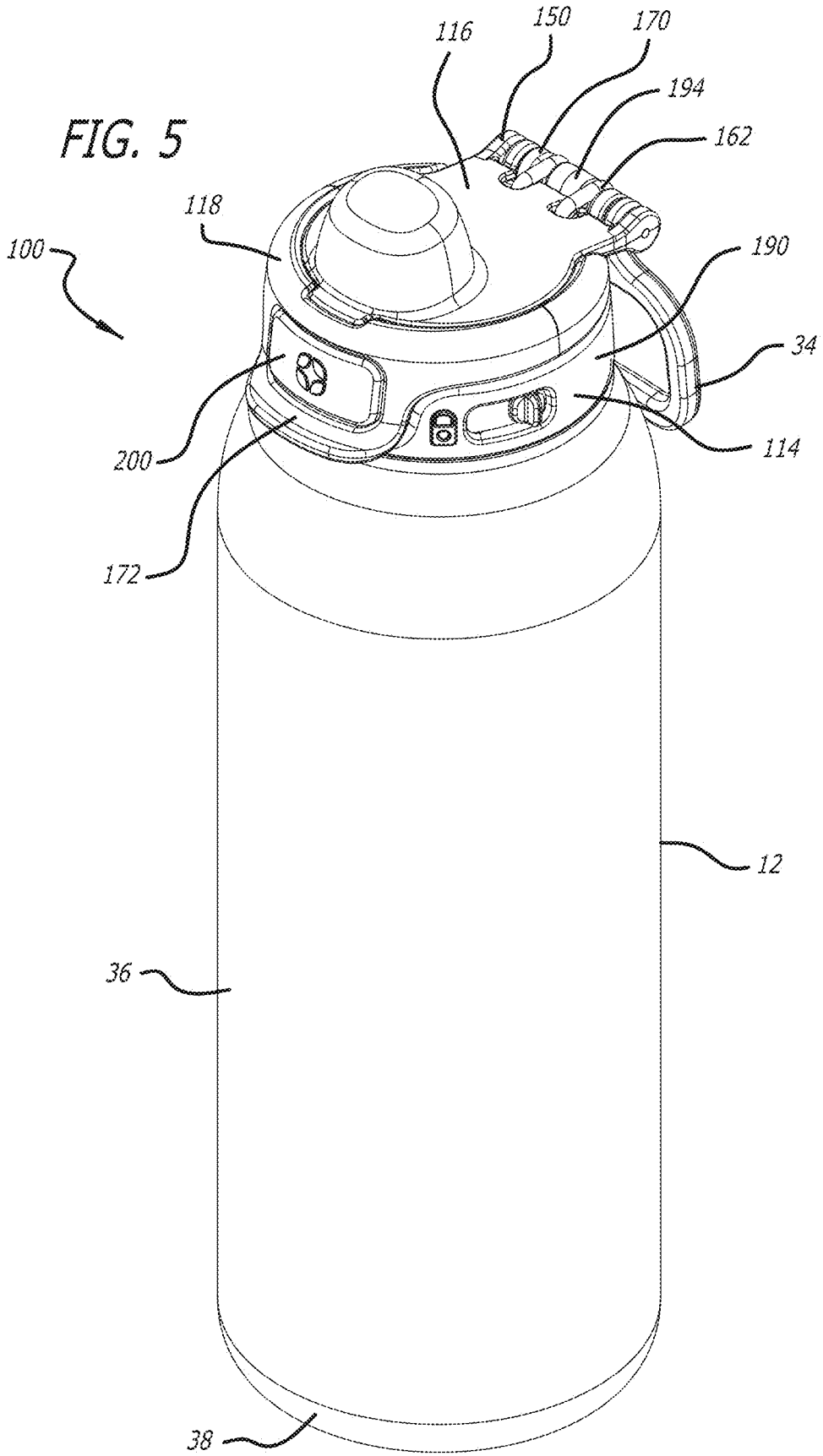
FIG. 5 is a perspective view of another embodiment of a quick-fill lid for a beverage container, with the lid in the closed position, according to the present disclosure.
Figure 7:
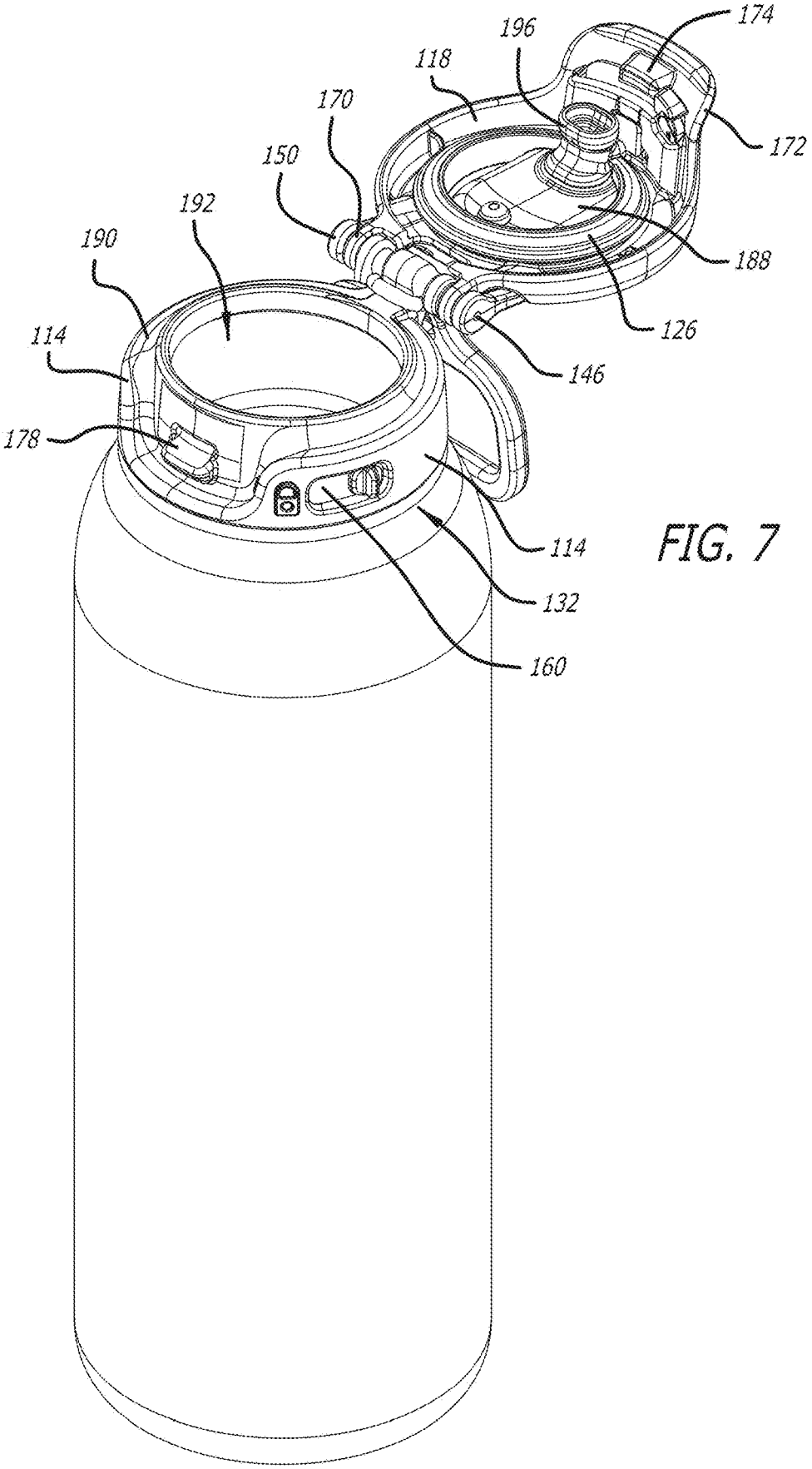
FIG. 7 is a perspective view of the quick-fill lid of FIG. 5, with the top closure and the fill cap pivoted open, according to the present disclosure.
Figure 8:
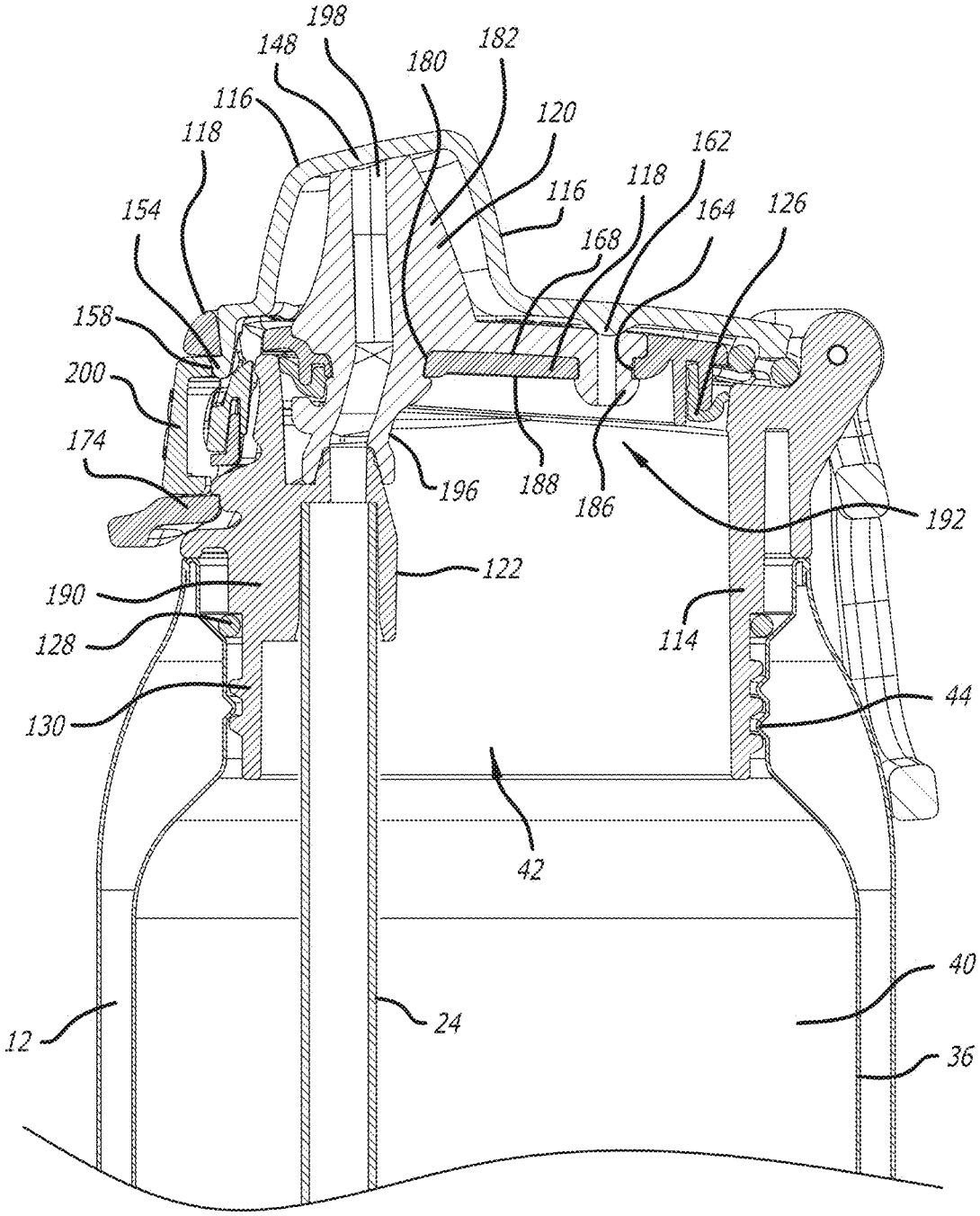
FIG. 8 is a cross-sectional view of the quick-fill lid of FIG. 5 in the closed position, according to the present disclosure.

As shown in FIGS. 5-8, in one embodiment the top closure 116 has a cover portion 148, pivot arms 150, and a release flange 154. The pivot arms 150 are pivotally secured to the pivot shaft 146 of the lid housing 114. The top closure 116 can pivot from a closed position, as shown in FIGS. 5 and 8, to an open position, as shown in FIGS. 6 and 7 about the pivot shaft 146. The release flange 154 extends from the cover portion 148 and engages a lock receiver 158 on the lid housing 114 in the closed position to secure the top closure 116 in the closed position on the lid housing 114. The release flange 154 in this embodiment is operated by a push button 200 to move it away from the lock receiver 158 to open the top closure 116. The push button 200 is part of the fill cap 118. When the user pushes in the push button 200 the release flange 154 disengages from the lock receiver 158 to allow the top closure 116 to pivot to the open position about the pivot shaft 146 as shown in FIG. 7. In one embodiment, a bias member 162 is provided to bias the top closure 116 to the open position of FIG. 7 when the release flange 154 is disengaged from the lock receiver 158 after the push button 200 is depressed.

Moving to the fill cap 118, in one embodiment the fill cap 118 has a cover portion 168, pivot arms 170, a release member 172, and a release flange 174. The pivot arms 170 are pivotally secured to the pivot shaft 146 of the lid housing 114. The fill cap 118 can pivot from a closed position, as shown in FIGS. 5, 6 and 8, to an open position, as shown in FIG. 7 about the pivot shaft 146. The release member 172 extends downwardly from the cover portion 168. In one embodiment, the button member 200 is housed in the release member 172. The release flange 174 extends inwardly from the release member 172 and engages a lock receiver 178 on the lid housing 114 in the closed position to secure the fill cap 118 in the closed position on the lid housing 114. To open the fill cap 118 the user pulls on the release member 172 to disengage the release flange 174 from the lock receiver 178, and to allow the fill cap 118, including with the top closure 116 secured thereto, to pivot to the open position about the pivot shaft 146, as shown in FIG. 7.

In one embodiment, the fill cap 118 has a first opening 180 through the cover portion 168. The first opening 180 may be a drink opening, and may have a drink member 120 therein, such as a silicone drink spout 120, to be used by the user in drinking the liquid from the container cavity 40. Further, in one embodiment the fill cap 118 may have a second opening 164 to be used as a vent opening 164. The vent opening 164 may be sealed by the vent closure member 162 of the top closure 116 when the top closure 116 is secured to the fill cap 118. Further, a seal 186 may be provided in the vent opening 164 to allow for better sealing of the vent opening 164 by the vent closure member 162. The drink spout 120 may be sealed closed by the top closure 116 when the top closure 116 is secured to the fill cap 118 as shown in FIG. 8. As shown in FIGS. 7 and 8, the first seal 126, which is preferably connected adjacent a bottom 188 of the fill cap 118, seals the fill cap 118 to the lid housing 114 to sealingly close the opening 192 in the lid housing 114.

In one embodiment, a sliding lock member 160 of the locking mechanism 132 on the lid housing 114 can be moved between an unlocked position and a locked position. As discussed herein, and shown in FIGS. 9-11, in the locked position the sliding lock member 160 prevents the button 200 from being pushed inwardly to lock the top closure 116 on the fill cap 118.

The lid housing 114 has a housing body 190, a central opening 192 through the housing body 190, and a connection mechanism 130 to secure the lid housing 114 to the beverage container 12. The central opening 192 provides access to the internal cavity 40 of the beverage container 12 when the lid assembly 100 is secured to the beverage container 12. Thus, the first seal 126, which is preferably connected adjacent a bottom 188 of the fill cap 118, seals the central opening 192 of the lid housing 114 closed when the fill cap 118 is in the closed position. Additionally, the second seal 128 is provided around the connection mechanism 130 of the lid housing 114 to seal the lid housing 114 to the beverage container 12 when the lid housing 114 is secured to the beverage container 12. This sealingly closes the opening 42 at the top of the beverage container 12 to close access to the internal cavity 40 of the beverage container 12. The lid housing 114 also has a pivot arm 194 extending from the housing body 190 to secure the pivot shaft 146 thereto for engaging with the pivot arms 150 of the top closure 116 and the pivot arms 170 of the fill cap 118.

As best shown in FIG. 8, in one embodiment, the lid housing 114 has a connector 122. In one embodiment, the drink spout 120 has a sipping portion 182 extending above the cover portion 168 of the fill cap 118, and an engaging portion 196 extending below the bottom 188 of the fill cap 118. A fluid passageway 198 extends through the entirety of the drink spout 120. The engaging portion 196 of the drink spout 120 sealingly engages a top of the connector 122 when the fill cap 118 is in the closed position as shown in FIG. 8. In one embodiment, a straw 24 can be secured to a bottom of the connector 122. The connector 122 similarly has a fluid passageway 202 extending therethrough to fluidly connect the fluid passageway 198 of the drink spout 120 with the straw 24. The straw 24 may extend close to the bottom wall 38 of the beverage container 12 such that when the user sips or sucks on the drink spout 120, liquid is drawn from the bottom of the internal cavity 40 of the beverage container 12, through the straw 24, through the fluid passageway 202 in the connector 122, through the fluid passageway 198 in the drink spout 120 and into the mouth of the user.

Unlike many beverage containers, the user can fill the internal cavity 40 of the beverage container 12 of this embodiment without removing the lid assembly 100. The user merely pivots open the fill cap 118. When the fill cap 118 is opened the large central opening 192 through the housing body 190 of the lid housing 114 is accessible. The user can fill the internal cavity 40 of the beverage container with liquid directly through the large central opening 192 of the housing body 190. Further, the user can drink, such as a chug, directly from the large central opening 192 as well instead of through the drink spout 120, if so desired.

Figure 9:
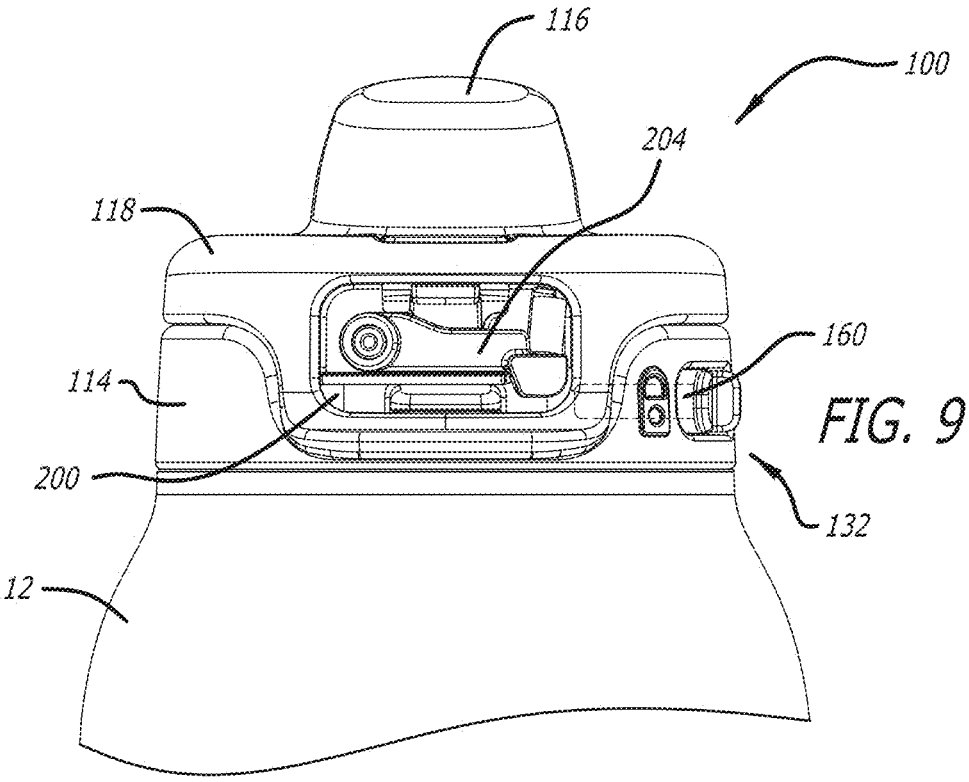
FIG. 9 is a front elevation view of the quick-fill lid of FIG. 5, with the locking mechanism for the release button in the unlocked position, according to the present disclosure.
Figure 10:
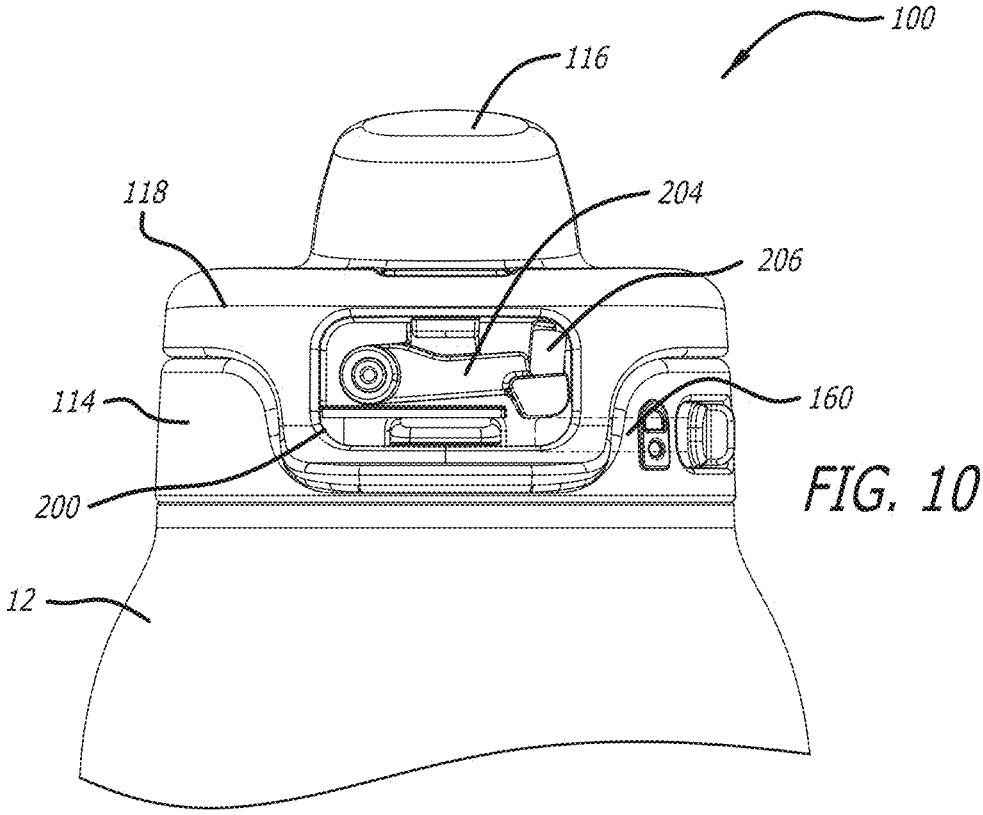
FIG. 10 is a front elevation view of the quick-fill lid of FIG. 5, with the locking mechanism for the release button in the locked position, according to the present disclosure.
Figure 11:
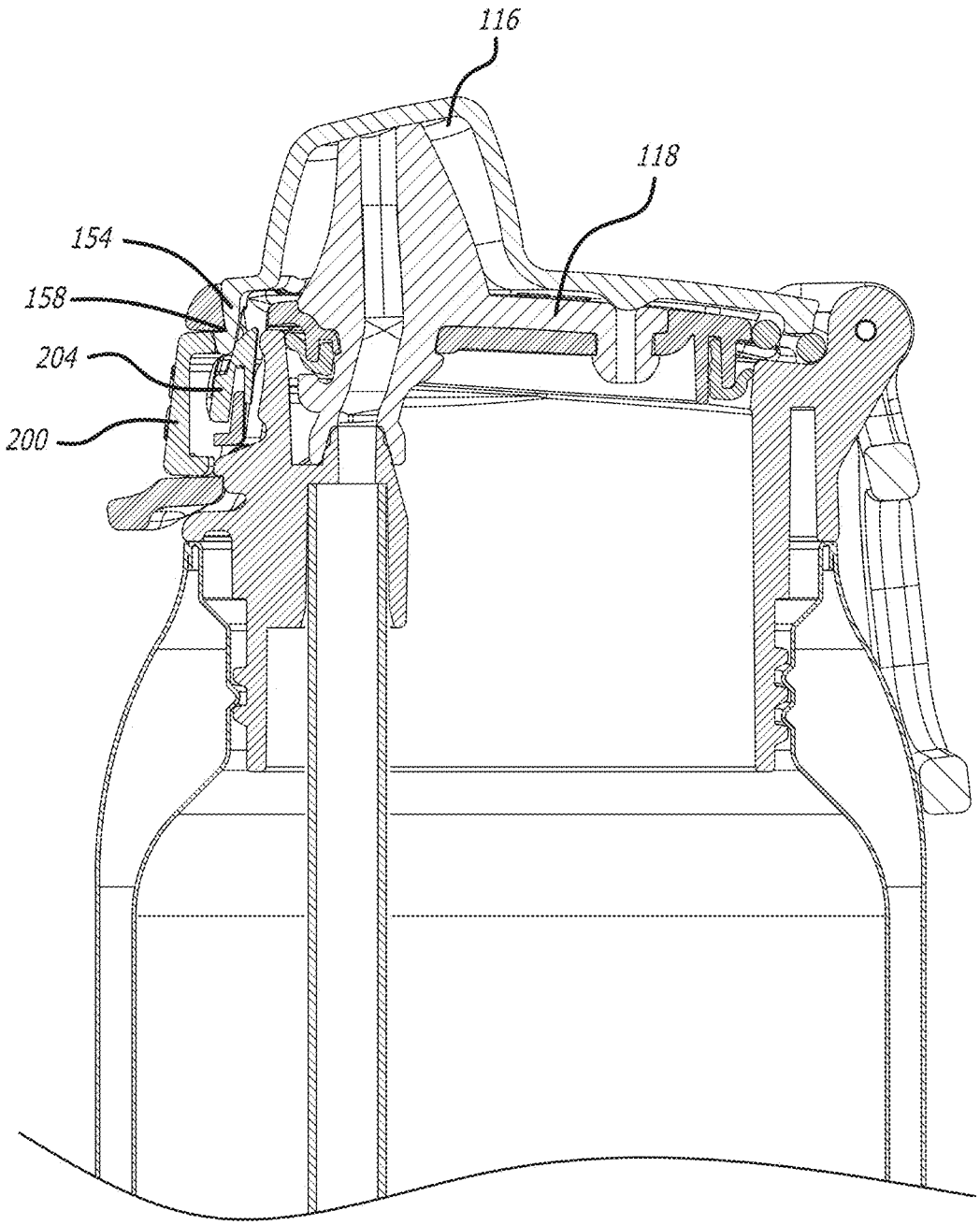
FIG. 11 is a cross-sectional view of the quick-fill lid of FIG. 10, with the locking mechanism for the release button in the locked position, according to the present disclosure.

As shown in FIGS. 9-11, in one embodiment, a sliding lock member 160 of the locking mechanism 132 on the lid housing 114 can be moved between an unlocked position and a locked position. As shown in FIGS. 10 and 11, in the locked position the sliding lock member 160 engages a pivotable secondary lock member 204 behind the button 200 and pivots the secondary lock member 204 upwardly such that the secondary lock member 204 prevents the button 200 being pushed inwardly and thus the top closure 116 remains secured in the closed position on the fill cap 118. Specifically, the secondary lock member 204 moves up to wedge behind the release flange 154 and prevent the push button 200 from disengaging the release flange 154 from the lock receiver 158. When the sliding lock member 160 is moved to the unlocked position, as shown in FIG. 9, a bias member 206 pushes the secondary lock member 204 down such that there is space behind the release flange 154, and then when the button 200 is depressed the button 200 can move the release flange 154 backwards and away from the lock receiver 158 to open the top closure 116.

The embodiments detailed hereinabove may be combined in full or in part, with any alternative embodiments described.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the present disclosure may be embodied in other specific forms without departing from the spirit or central characteristics thereof. The present examples and embodiments, therefore, are to be considered in all respects as illustrative and not restrictive, and the Claims are not to be limited to the details given herein. Accordingly, while the specific embodiments have been illustrated and described, numerous modifications come to mind without significantly departing from the spirit of the disclosure and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A quick-fill lid assembly for a beverage container, comprising:

a lid housing adapted to be connected to the beverage container, the lid housing having an opening providing access to a cavity of the beverage container, the lid housing also having a connector adjacent the opening, wherein the connector has a passageway therethrough;

a straw connected to the connector and extending into the beverage container;

a fill cap pivotally attached to the lid housing, the fill cap moving between a closed position and an open position, wherein the fill cap closes the opening in the lid housing in its closed position;

a drink spout connected to the fill cap, the drink spout having a first end and a second end, and a fluid passageway extending from the first end to the second end, the second end of the drink spout contacting the connector when the fill cap is in the closed position such that the fluid passageway of the drink spout is fluidly connected to the passageway through the connector and to a passageway through the straw to allow the user to drink fluid from the beverage container through the drink spout; and, a top closure pivotally attached to the lid housing, the top closure moving between an open position and a closed position, wherein the top closure covers the drink spout when the top closure is in the closed position.

2. The quick-fill lid assembly of claim 1, wherein the top closure and the fill cap are independently pivotally connected to the housing.

3. The quick-fill lid assembly of claim 1, wherein the top closure is pivotal about a pivot shaft, and wherein the fill cap is pivotal about the same pivot shaft.

4. The quick-fill lid assembly of claim 1, wherein the top closure has a cover portion, pivot arms and a release flange.

5. The quick-fill lid assembly of claim 4, wherein the release flange on the top closure engages a lock receiver on the lid housing.

6. The quick-fill lid assembly of claim 1, wherein the fill cap has a cover portion, pivot arms, a release member and a release flange.

7. The quick-fill lid assembly of claim 6, wherein the release flange on the fill cap engages a lock receiver on the lid housing.

8. The quick-fill lid assembly of claim 1, wherein the fill cap has a button, and wherein when the button is depressed the release flange of the top closure is disengaged from the lock receiver of the top closure to open the top closure.

9. The quick-fill lid assembly of claim 1, wherein the fill cap is opened the top closure remains in the closed position.

10. The quick-fill lid assembly of claim 1, wherein to access the cavity of the beverage container with the lid assembly on the beverage container, the top closure and the fill cap are moved to the open position.

11. A quick-fill lid assembly for a beverage container, comprising:

a lid housing adapted to be connected to the beverage container, the lid housing having a fill opening providing access to a cavity of the beverage container;

a fill cap pivotally attached to the lid housing, the fill cap moving between a closed position and an open position, wherein the fill cap closes the fill opening in the lid housing in its closed position;

the lid assembly having a drink opening and a vent opening, wherein the drink opening and the vent opening are both separate from the fill opening, and wherein the fill opening is larger than both the drink opening and the vent opening; and, the lid assembly further having a drink spout for the drink opening, the drink spout being separate from the lid housing and the fill cap, and the drink spout having a fluid passageway therethrough.

12. The quick-fill lid assembly of claim 11, wherein the lid housing has a connector adjacent the fill opening, the connector having a passageway therethrough, and further comprising a straw connected to the connector and extending into the beverage container.

13. The quick-fill lid assembly of claim 12, wherein the drink spout has a first end and a second end, and the fluid passageway extending from the first end to the second end, the second end of the drink spout contacting the connector when the fill cap is in the closed position such that the fluid passageway of the drink spout is fluidly connected to the passageway through the connector and to a passageway through the straw to allow the user to drink fluid from the beverage container through the drink spout.

14. The quick-fill lid assembly of claim 11, further comprising a top closure pivotally attached to the lid housing, the top closure moving between an open position and a closed position, wherein the top closure covers the drink spout when the top closure is in the closed position, wherein the top closure and the fill cap are independently pivotally connected to the housing, wherein the top closure is pivotal about a pivot shaft, and wherein the fill cap is pivotal about the same pivot shaft.

15. The quick-fill lid assembly of claim 11, wherein the fill cap has a cover portion, pivot arms, a release member and a release flange, and wherein the release flange on the fill cap engages a lock receiver on the lid housing.

16. The quick-fill lid assembly of claim 11, wherein the top closure has a cover portion, pivot arms and a release flange, and wherein the release flange on the top closure engages a lock receiver on the lid housing.

17. A quick-fill lid assembly for a beverage container, comprising:

a lid housing adapted to be connected to the beverage container, the lid housing having an opening providing access to a cavity of the beverage container, the lid housing also having a connector;

a straw connected to the connector and extending into the beverage container;

a fill cap pivotally attached to the lid housing, the fill cap moving between a closed position and an open position, wherein the fill cap closes the opening in the lid housing in its closed position; and, a drink spout connected to the lid assembly, the drink spout having a first end and a second end, and a fluid passageway extending from the first end to the second end, the fluid passageway of the drink spout being fluidly connected to a passageway through the straw to allow the user to drink fluid from the beverage container through the drink spout.

18. The quick-fill lid assembly of claim 17, further comprising a top closure pivotally attached to the lid assembly, the top closure moving between an open position and a closed position, wherein the top closure covers the drink spout when the top closure is in the closed position.

19. The quick-fill lid assembly of claim 18, wherein the top closure and the fill cap are independently pivotally connected to the housing, wherein the top closure is pivotal about a pivot shaft, and wherein the fill cap is pivotal about the same pivot shaft.

20. The quick-fill lid assembly of claim 17, wherein the fill cap has a cover portion, pivot arms, a release member and a release flange, and wherein the release flange on the fill cap engages a lock receiver on the lid housing.

* * * * *